US007617633B2

(12) United States Patent
Shimura et al.

(10) Patent No.: US 7,617,633 B2
(45) Date of Patent: Nov. 17, 2009

(54) VEHICULAR WINDOW REGULATOR

(75) Inventors: Ryoji Shimura, Yokohama (JP); Toru Shibata, Yokohama (JP)

(73) Assignee: Mitsui Mining and Smelting Co., Ltd., Tokyo (JP)

( * ) Notice: Subject to any disclaimer, the term of this patent is extended or adjusted under 35 U.S.C. 154(b) by 17 days.

(21) Appl. No.: 11/907,061

(22) Filed: Oct. 9, 2007

(65) Prior Publication Data

US 2008/0086949 A1 Apr. 17, 2008

(30) Foreign Application Priority Data

Oct. 11, 2006 (JP) ..... P2006-277505

(51) Int. Cl.
*E05F 15/08* (2006.01)

(52) U.S. Cl. ..... 49/349; 49/348; 49/352

(58) Field of Classification Search ..... 49/348, 49/349, 350, 351, 352
See application file for complete search history.

(56) References Cited

U.S. PATENT DOCUMENTS 4,494,336 A * 1/1985 Ishii et al. ..... 49/352
4,502,247 A * 3/1985 Kobayashi et al. ..... 49/352
4,663,886 A * 5/1987 Nakamura et al. ..... 49/360
4,700,508 A 10/1987 Köllner et al. ..... 49/352
4,759,653 A * 7/1988 Maekawa et al. ..... 403/24
5,970,658 A * 10/1999 Smith ..... 49/352
6,052,947 A * 4/2000 Smith ..... 49/352
6,088,965 A * 7/2000 Fukumoto et al. ..... 49/352
6,115,966 A * 9/2000 Shibata ..... 49/352
6,553,720 B2 * 4/2003 Merlet ..... 49/440
7,213,370 B2 * 5/2007 Dedrich et al. ..... 49/358

FOREIGN PATENT DOCUMENTS

EP 230697 A1 * 8/1987
JP 02272186 A * 11/1990
JP 03172483 A * 7/1991
JP 5-3515 1/1993

* cited by examiner

*Primary Examiner*—Jerry Redman
(74) *Attorney, Agent, or Firm*—The Nath Law Group; Jerald L. Meyer; Stanley N. Protigal

(57) ABSTRACT

A curved portion formed on a guide rail is sandwiched between an inscribed projection and a circumscribed projection. Therefore, a carrier plate can turn around a curving center of the inscribed projection. Even when the guide rail is twisted, an element to be guided and the carrier plate can turn in accordance with the twist, a prying force is reduced, and the carrier plate can vertically move smoothly.

10 Claims, 7 Drawing Sheets

VEHICULAR WINDOW REGULATOR

CROSS REFERENCE TO RELATED APPLICATION

This application is based upon and claims the benefit of priority from a Japanese Patent Application No. 2006-277505, filed on Oct. 11, 2006; the entire contents of which are incorporated herein by reference.

BACKGROUND OF THE INVENTION

1. Field of the Invention

The present invention relates to a vehicular window regulator.

2. Description of the Related Art

A conventional vehicular window regulator is generally provided with a carrier plate capable of vertically moving along a guide rail which is fixed to a door and extends in the vertical direction, and a window glass is held by the carrier plate. In this case, a wire which is vertically driven is wound around the guide rail, the carrier plate is coupled to the wire, and the carrier plate which is integral with the window glass vertically moves.

The guide rail has a hat-shaped cross section. The carrier plate is provided with a pair of sandwiching pieces which sandwich a flange of the guide rail in a widthwise direction of the vehicle.

The guide rail is twisted along a curve of the window glass in some cases. When the flange of the guide rail is sandwiched by the pair of sandwiching pieces, the carrier plate can be vertically moved such as to follow a predetermined locus while turning the carrier plate in accordance with the twist.

If the carrier plate is vertically moved while being twisted, however, a reaction force in the longitudinal direction of the vehicle is applied to the sandwiching pieces in addition to a reaction force in the widthwise direction of the vehicle. Therefore, a friction force with respect to the guide rail is increased, there is an adverse possibility that a smooth vertical motion is hindered and a friction is increased.

Hence, there has been proposed a technique in which bent portions having spring effects in the widthwise direction and the longitudinal direction of the vehicle are formed in front of and behind the guide rail, rotation of the carrier plate is permitted by elastic deformations of the bent portions and in this state, rattling in the widthwise direction and the longitudinal direction of the vehicle is suppressed (for example, see Japanese Examined Patent Publication (Kokoku) No. H05-3515).

However, the conventional technique has a problem that since it is necessary to form the bent portions in front of and behind the guide rail, the cross section shape of the guide rail is complicated, it becomes difficult to manufacture the guide rail, and it is difficult to assemble the carrier plate.

SUMMARY OF THE INVENTION

It is an object of the present invention to obtain a vehicular window regulator capable of realizing a more smooth vertical motion of the carrier plate with a relatively simple structure.

A first aspect of the present invention provides a vehicular window regulator comprising a guide rail which is fixed to a door and extended in a vertical direction, and a carrier plate on which an element to be guided that is guided by the guide rail and which vertically moves along the guide rail, wherein the guide rail is provided with a curved portion having a substantially constant arc cross section in a longitudinal direction, the element to be guided is provided with an inscribed projection having a curved surface which is inscribed with the curved portion and a circumscribed projection which is circumscribed with the curved portion, and the curved portion is sandwiched between the inscribed projection and the circumscribed projection.

It is preferable that one of the inscribed projection and the circumscribed projection is divided into upper and lower two pieces and they are separated from each other, and the other one of the inscribed projection and the circumscribed projection is disposed between the divided two pieces.

It is preferable that an abutting surface of the circumscribed projection is a spherical surface or a columnar surface.

It is preferable that the guide rail has a substantially hat-shaped cross section protruding in a widthwise direction of a vehicle, the curved portion is disposed at a corner portion of the substantially hat-shaped cross section, and an abutting surface of the circumscribed projection extends along a substantially horizontal direction intersecting with the widthwise direction and a longitudinal direction of the vehicle.

It is preferable that the guide rail has a substantially hat-shaped cross section protruding in a widthwise direction of a vehicle, two flanges are formed in front of and behind the guide rail one each, one of the two flanges is curved into an arc shape around a curving center of the inscribed projection, the element to be guided is formed with an arc receiving groove in which the arc flange is accommodated and the flange slides, and the receiving groove and the one flange slide with each other.

It is preferable that a vehicular window regulator comprising a guide rail which is fixed to a door and extended in a vertical direction, and a carrier plate on which an element to be guided that is guided by the guide rail and which vertically moves along the guide rail, wherein the guide rail is provided with a curved portion having a substantially constant arc cross section in a longitudinal direction, the element to be guided is provided with an inscribed projection having a curved surface which is inscribed with the curved portion, the curved portion is curved such as to protrude in a widthwise direction of a vehicle, and the inscribed projection is sandwiched by the curved portion in a longitudinal direction of the vehicle.

DETAILED DESCRIPTION OF THE PREFERRED EMBODIMENTS

First Embodiment

Figure 1:
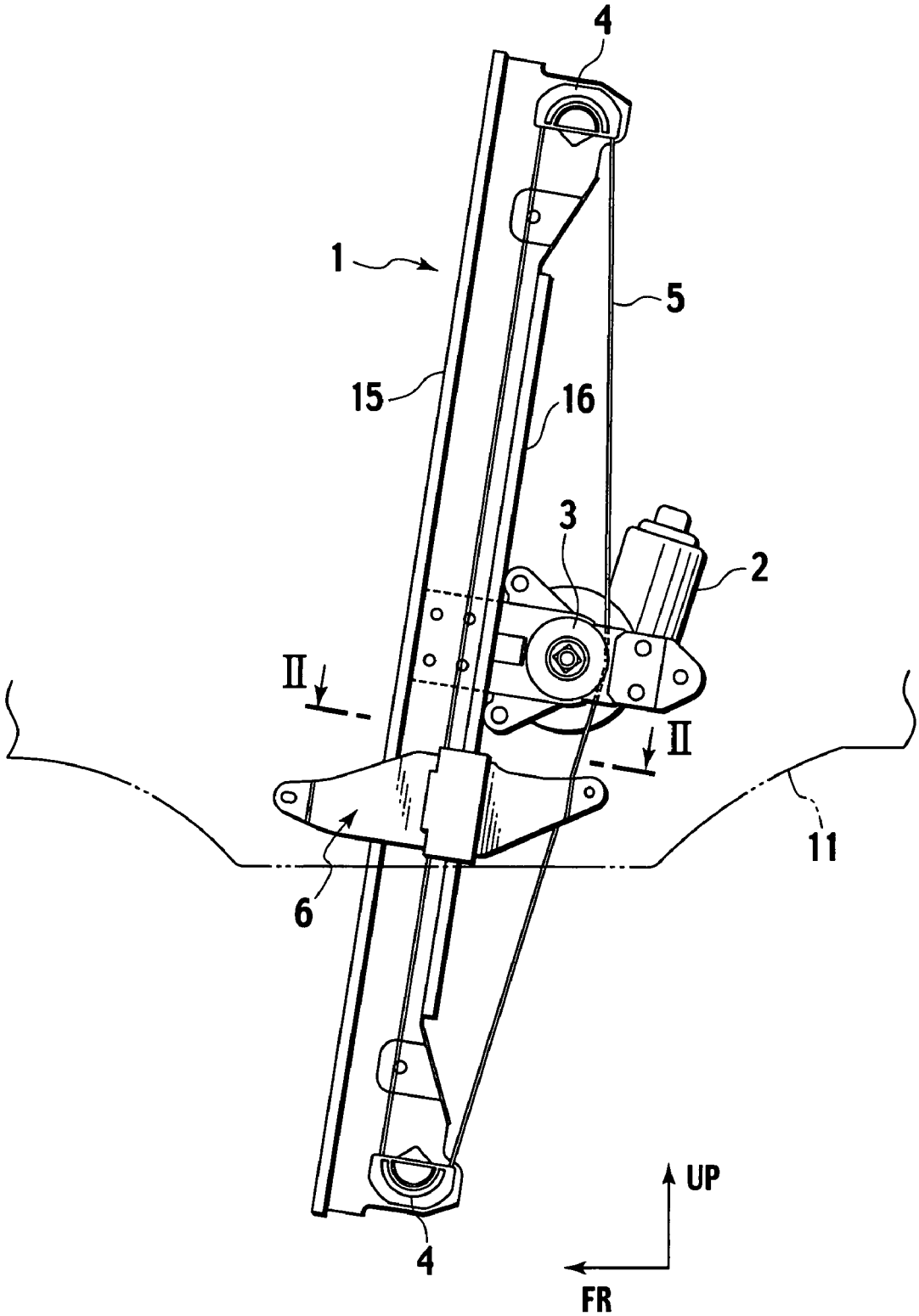
FIG. 1 is a side view of a window regulator according to a first embodiment of the present invention.
Figure 2:
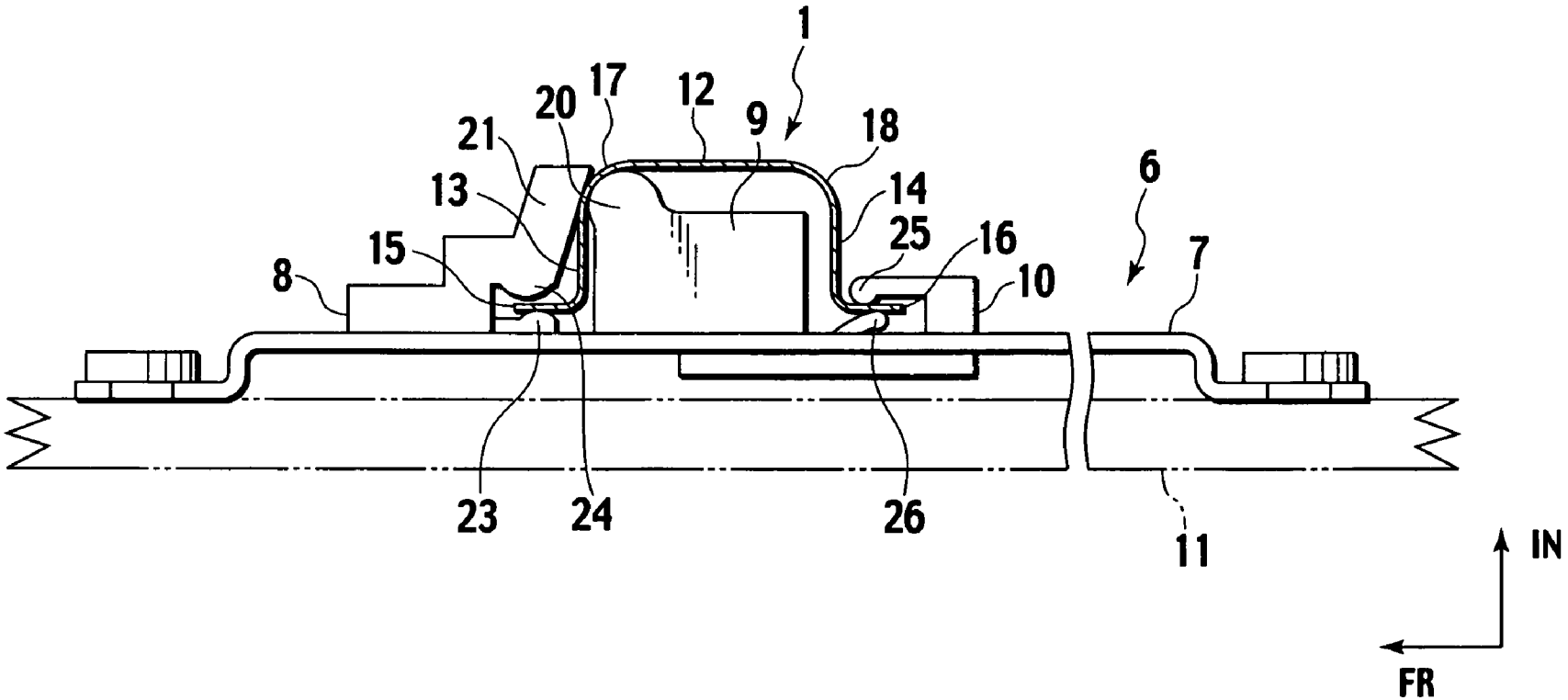
FIG. 2 is a sectional view of the window regulator taken along the arrow line II-II in FIG. 1.
Figure 3:
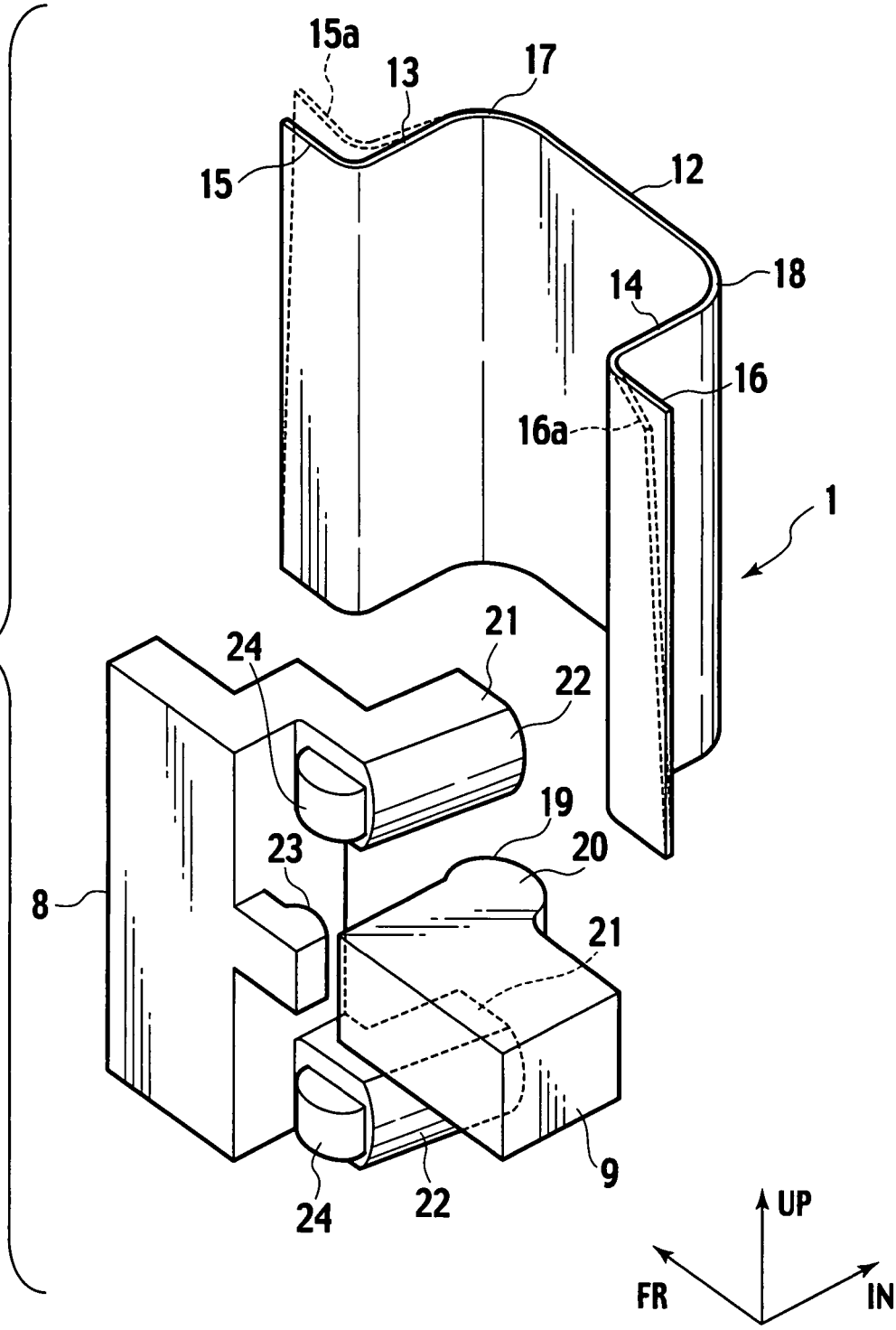
FIG. 3 is a perspective view showing an inscribed projection and a circumscribed projection.
Figure 4:
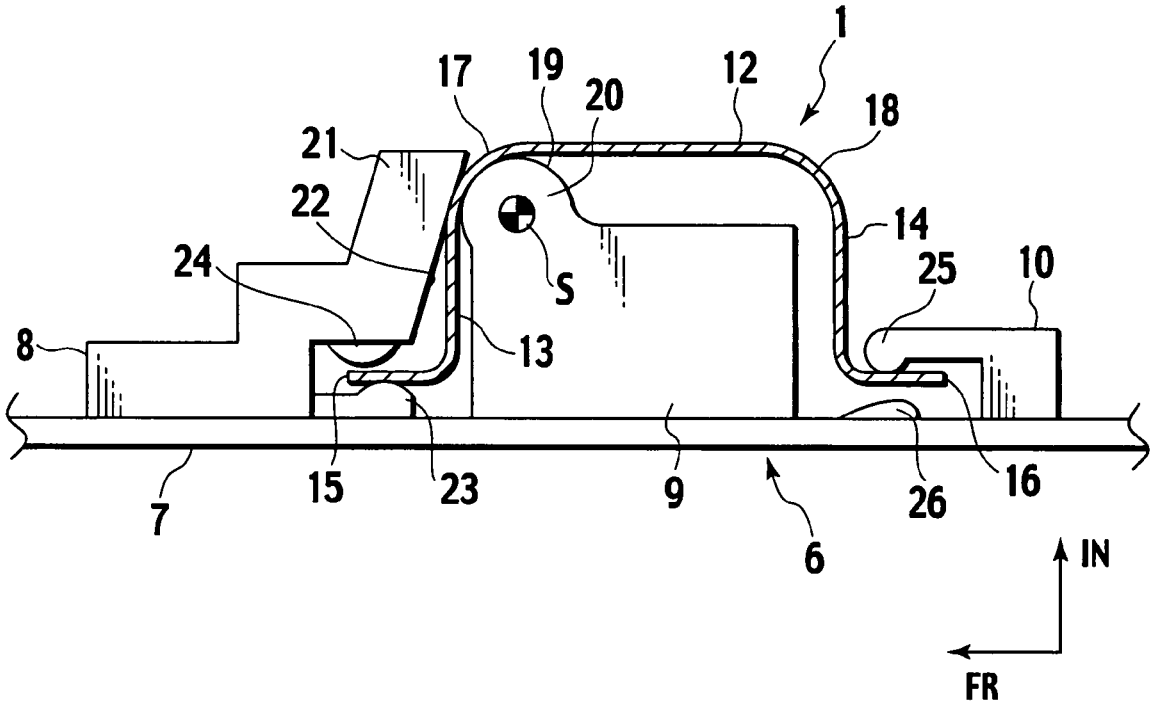
FIG. 4 is a sectional view of relevant parts of the window regulator.
Figure 5:
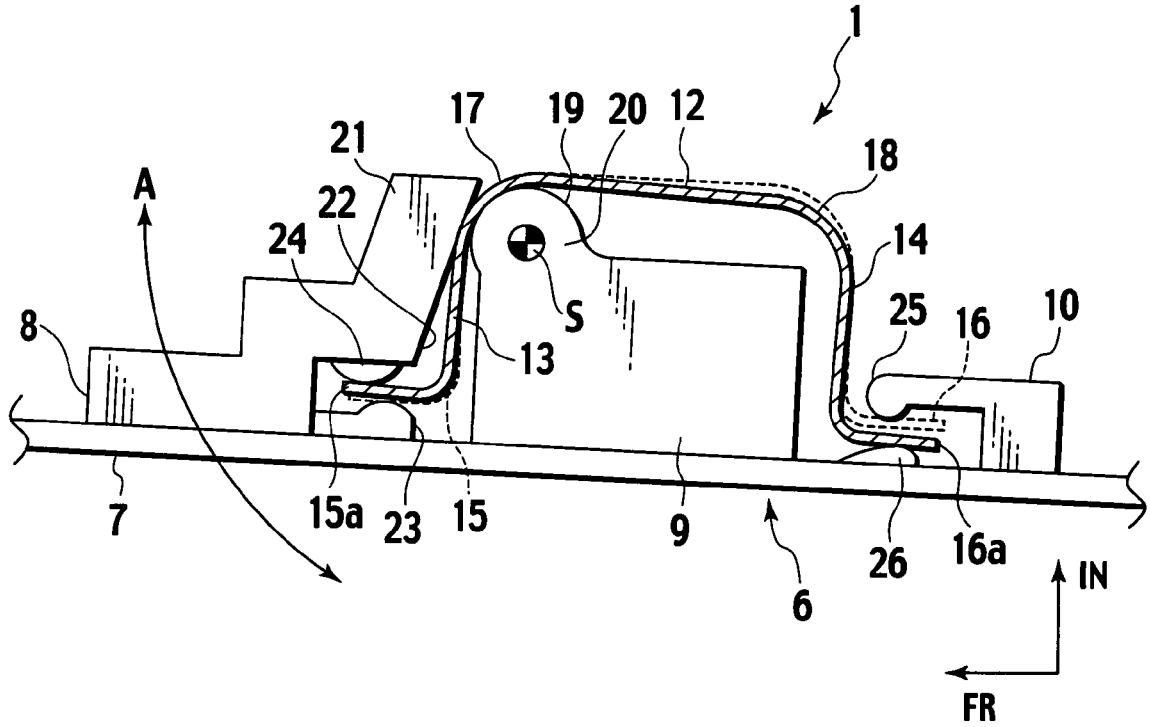
FIG. 5 is a sectional view corresponding to FIG. 4 showing a state where the carrier plate rotates.
Figure 6:
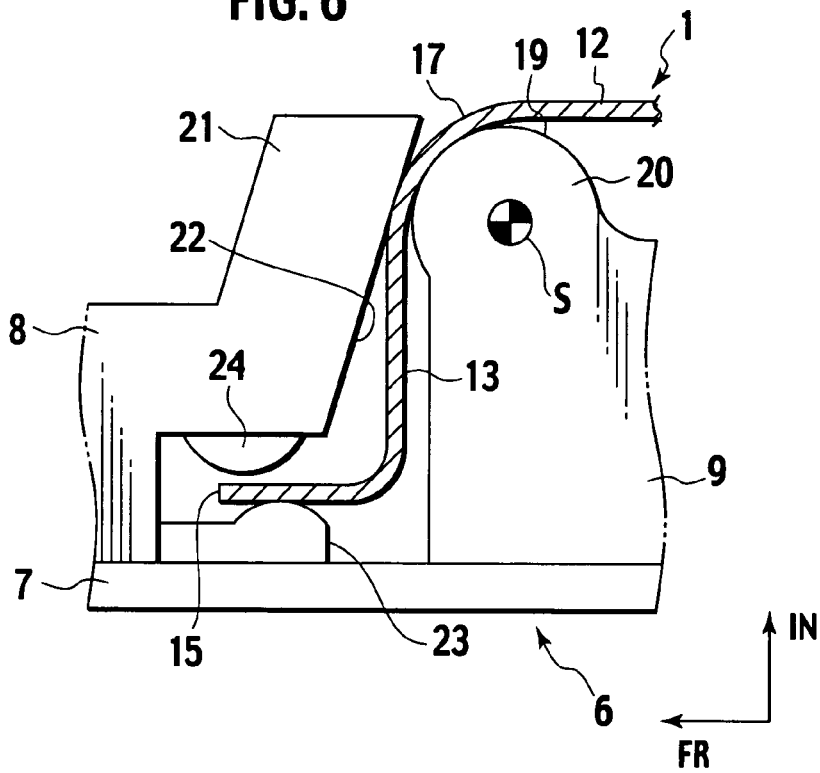
FIG. 6 is an enlarged sectional view showing a state where the inscribed projection and the circumscribed projection sandwich a curved portion.
Figure 7:
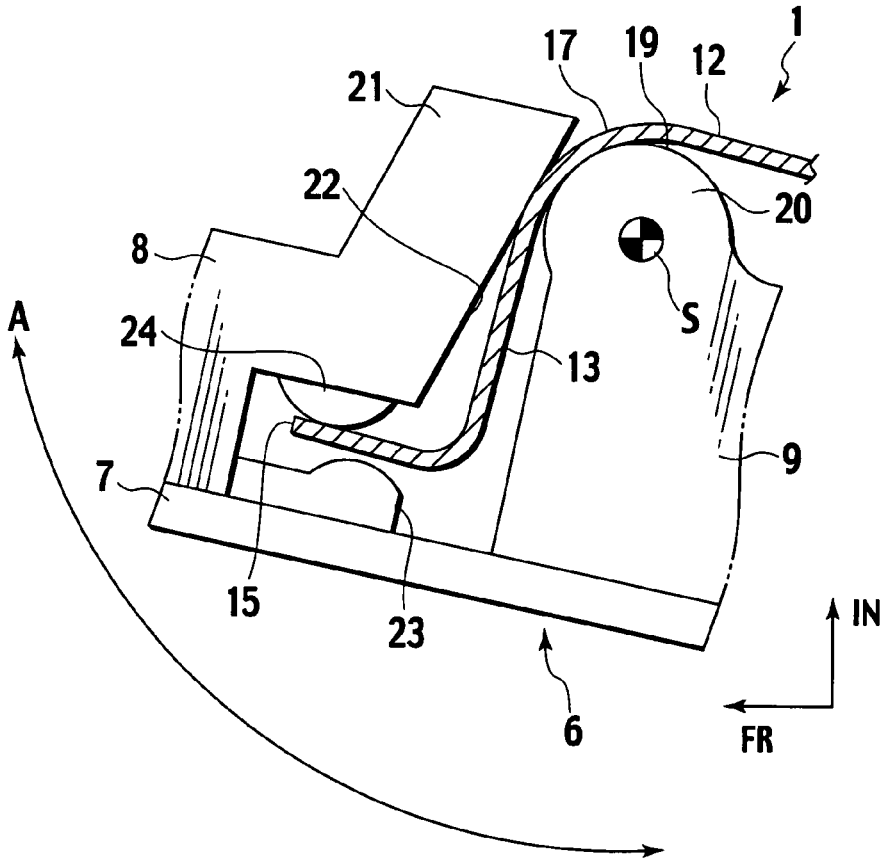
FIG. 7 is a sectional view corresponding to FIG. 6 showing a state where the carrier plate rotates.

FIG. 1 is a side view of a window regulator according to a first embodiment of the present invention, provided on a left door as viewed from outside of a vehicle. FIG. 2 is a sectional view (of only a guide rail) of the window regulator taken along the arrow line II-II in FIG. 1. FIG. 3 is an exploded perspective view showing an inscribed projection and a circumscribed projection. FIG. 4 is a sectional view of relevant parts of the window regulator. FIG. 5 is a sectional view of relevant parts corresponding to FIG. 4 showing a state where the carrier plate rotates. FIG. 6 is an enlarged sectional view showing a state where the inscribed projection and the circumscribed projection sandwich a curved portion. FIG. 7 is an enlarged sectional view corresponding to FIG. 6 showing a state where the carrier plate rotates. In FIG. 7, a turning motion of the carrier plate is exaggerated so that operation can be understood easily. In the drawings, FR represents vehicle front in the longitudinal direction of the vehicle, IN represents inside of a passenger room in the widthwise direction of the vehicle, and UP represents upward.

As shown in FIG. 1, a vertically extending guide rail 1 is fixed to an inner portion of a door in such an attitude that the guide rail 1 is slightly inclined rearward. A drum 3 is mounted on an intermediate portion of the guide rail 1. The drum 3 is rotated by a motor 2. A wire 5 is wound around the drum 3 and upper and lower guide portions 4 and 4.

The carrier plate 6 is assembled into the guide rail 1 such that the carrier plate 6 can vertically slide. The carrier plate 6 is integrally provided with a metal plate portion 7, resin protrusions 8, 9 and 10 and sandwiching pieces 23 and 26. Both ends of the metal plate portion 7 in the longitudinal direction are fixed to a lower end of a window glass 11, and a wire 5 is coupled to a central portion of the metal plate portion 7 in its longitudinal direction. In the present embodiment, the protrusions 8, 9 and 10 and the sandwiching pieces 23 and 26 correspond to elements to be guided.

The guide rail 1 has a substantially hat-shaped cross section whose outer side in the widthwise direction of the vehicle is opened. That is, front and rear portions of a top wall 12 of the guide rail 1 are bent and a front wall 13 and a rear wall 14 are provided as side walls, and outer ends of the top wall 12 in the widthwise direction of the vehicle are bent and flanges 15 and 16 are provided. A corner portion of a boundary between the top wall 12 and the front wall 13, and a corner portion of a boundary between the top wall 12 and the rear wall 14 are formed with curved portions 17 and 18 which are bent in arc shape. That is, the curved portions 17 and 18 have substantially constant arc cross sections in the longitudinal direction.

As shown with broken lines in FIG. 3, the guide rail 1 is gradually twisted in accordance with a curve of the window glass 11, and angles of twisted flanges 15*a* and 16*a* are gradually changed.

The protrusion 9 of a central portion of the carrier plate 6 is formed with an inscribed projection 20 which obliquely projects. The inscribed projection 20 is formed with a curved surface 19 which abuts against the front curved portion 17 of the guide rail 1 from an inner side. The curved surface 19 is formed into a semi-columnar surface.

Two circumscribed projections 21 and 21 obliquely project from the front protrusion 8 inward of the passenger room along the substantially horizontal direction intersecting with the longitudinal direction and the widthwise direction of the vehicle in a state where the circumscribed projections 21 and 21 are vertically separated from each other. Each the circumscribed projection 21 is formed into a substantially crank shape, and formed at its rear side with an abutting surface 22. The abutting surface 22 abuts against the curved portion 17 of the guide rail 1 from the front side, and the curved portion 17 is sandwiched in the longitudinal direction between the abutting surface 22 and the curved surface 19 of the inscribed projection 20 located behind the abutting surface 22.

The abutting surface 22 extends straightly along a substantially horizontal direction intersecting with the longitudinal direction and the widthwise direction of the vehicle, but since the cross section of the abutting surface 22 is curved in the vertical direction, the abutting surface 22 and the curved portion 17 are almost in point-contact with each other.

In the present embodiment, the two circumscribed projections 21 and 21 are separated from each other in the vertical direction as shown in FIG. 3, and the inscribed projection 20 is disposed between the circumscribed projections 21 and 21.

Further, a projection 24 is formed on a base end of each circumscribed projection 21 such as to be opposed to the sandwiching piece 23 in the widthwise direction of the vehicle. The front flange 15 of the guide rail 1 is sandwiched between the sandwiching piece 23 and the projection 24 in the widthwise direction of the vehicle.

Meanwhile, the rear flange 16 is sandwiched between a projection 25 formed on a protrusion 10 and the sandwiching piece 26 opposed to the projection 25 in the widthwise direction of the vehicle.

With the structure described above, if the wire 5 upwardly moves by the operation of the motor 2, the carrier plate 6 is pulled up by the wire 5 along the guide rail 1, and the window glass 11 rises.

In a portion of the guide rail 1 which is not twisted (or only slightly twisted), elements to be guided in front of and behind the guide rail 1 sandwich the flanges 15 and 16, and this prevents the carrier plate 6 from rattling in the widthwise direction of the vehicle.

Further, in the longitudinal direction of the vehicle also, the curved portion 17 of the guide rail 1 is sandwiched between the curved surface 19 of the inscribed projection 20 and the abutting surface 22 of the circumscribed projection 21, and this prevents the carrier plate from rattling in the longitudinal direction of the vehicle. Therefore, the carrier plate 6 is smoothly moved vertically.

Meanwhile, when the carrier plate 6 is in a region where the guide rail 1 is twisted, elements to be guided 23, 24, 25 and 26 are displaced along the twisted flanges 15*a* and 16*a* of the guide rail 1, and the carrier plate 6 tries to turn along the twist.

At that time, in the present embodiment, since the curved portion 17 of the guide rail 1 is sandwiched between the inscribed projection 20 and the circumscribed projection 21, this sandwiched state of the curved portion 17 is maintained even if the carrier plate 6 turns. Therefore, the carrier plate 6 can turn around the curving center S of the inscribed projection 20 in the turning direction A in the drawing without a hitch, this prevents the carrier plate from rattling in the widthwise direction and the longitudinal direction of the vehicle and the carrier plate 6 can smoothly move vertically.

As explained above, according to the present embodiment, the guide rail 1 is provided with the curved portion 17 having a substantially constant arc cross section in the longitudinal direction. The guide rail 1 is also provided on the side of the carrier plate 6 with the inscribed projection 20 having the curved surface 19 which is inscribed with the curved portion 17 and with the circumscribed projection 21 which is circumscribed with the curved portion 17, and the curved portion 17 is sandwiched between the inscribed projection 20 and the circumscribed projection 21. Therefore, even when the guide rail 1 is twisted, the elements to be guided turn along the curved portion 17 and a prying force is less prone to be applied. Thus, the carrier plate 6 can vertically move more smoothly and friction of the elements to be guided can be suppressed. The present invention has the relatively simple structure in which the curved portion 17 formed on the guide rail 1 is sandwiched between the inscribed projection 20 and the circumscribed projection 21. Thus, there is an advantage that the vehicular window regulator can be manufactured and assembled more easily.

According to the present embodiment, the circumscribed projection 21 is divided into two of upper and lower pieces, they are separated from each other, and the inscribed projection 20 is disposed therebetween. Therefore, it is possible to prevent the carrier plate 6 from vertically rocking and rattling.

According to the present embodiment, since the abutting surface 22 of the circumscribed projection 21 is formed into the columnar surface, the contact area of the circumscribed projection 21 with respect to the curved portion 17 can be reduced and the sliding resistance can be reduced correspondingly. Therefore, the carrier plate 6 can vertically move more smoothly.

According to the present embodiment, the guide rail 1 has the substantially hat-shaped cross section protruding in the widthwise direction of the vehicle, the curved portion 17 is disposed at the corner portion of the substantially hat-shaped cross section, and the abutting surface 22 of the circumscribed projection 21 extends along the substantially horizontal direction intersecting with the widthwise direction and the longitudinal direction of the vehicle. Therefore, even if the position of the front wall 13 of the guide rail 1 having the substantially hat-shaped cross section is changed along the twist of the guide rail 1, and a gap can be secured between the abutting surface 22 and the front wall 13 while keeping the contact state between the abutting surface 22 and the curved portion 17. Therefore, it is possible to prevent the abutting surface 22 from interfering with the front wall 13, and the carrier plate 6 can vertically move more smoothly.

Second Embodiment

Figure 8:
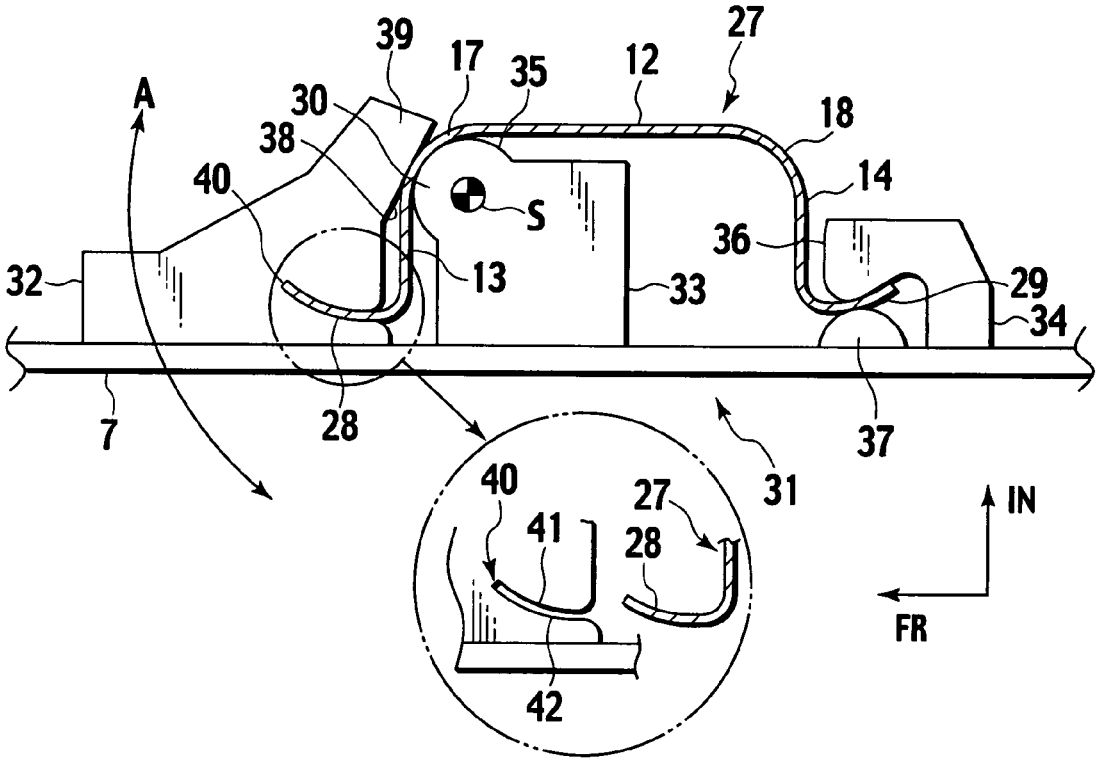
FIG. 8 is a sectional view of relevant parts of a window regulator according to a second embodiment of the present invention.

FIG. 8 is a sectional view of relevant parts of a window regulator according to a second embodiment of the present invention. The window regulator of the second embodiment has like constituent elements as those of the first embodiment. Therefore, these like constituent elements are designated with like reference symbols and redundant explanations will be omitted.

In the present embodiment, the flanges 28 and 29 in front of and behind a guide rail 27 are curved into arcs around the curving center S of an inscribed projection 30.

Like the first embodiment, a carrier plate 31 has three protrusions 32, 33 and 34, the central protrusion 33 is provided with the inscribed projection 30, and the inscribed projection 30 is formed with a curved surface 35 which is inscribed with the curved portion 17. In the present embodiment, the projections 32, 33 and 34 and a sandwiching piece 37 correspond to the elements to be guided.

The rear flange 29 is formed by bending a rear wall 14 of the guide rail 27. The flange 29 is sandwiched between a projection 36 formed on a protrusion 34 and the sandwiching piece 37 opposed to the projection 36 in the widthwise direction of the vehicle.

Further, the front protrusion 32 is formed with a circumscribed projection 39 having an abutting surface 38. The abutting surface 38 is circumscribed with the curved portion 17 of the guide rail 27. The protrusion 32 is formed with an arc receiving groove 40 in which the arc flange 28 is received and with which the flange 28 slides. As the carrier plate 31 vertically moves, the receiving groove 40 and the flange 28 slide with each other.

In this structure, even when the elements to be guided turn around the curving center S of the curved surface 35 as the guide rail 27 is twisted, since the sliding state between the receiving groove 40 and the flange 28 can be maintained, the elements to be guided can stably be held with respect to the guide rail 27, and it is possible to prevent the carrier plate 31 from rocking and rattling in the widthwise direction and the longitudinal direction of the vehicle.

In this structure, a portion which is cut by the receiving groove 40 corresponds to the inscribed projection and the circumscribed projection. In this case, an inner wall surface 41 of the receiving groove 40 on the side of the curving center is an abutting surface of the inscribed projection, and an inner wall surface 42 on an outer side of the curve is an abutting surface of the circumscribed projection. That is, according to the present embodiment, the inscribed projection and the circumscribed projection which sandwich (the flange 28) of the guide rail 27 can be obtained as more simple structures by forming the receiving groove 40 in the protrusion 32.

Third Embodiment

Figure 9:
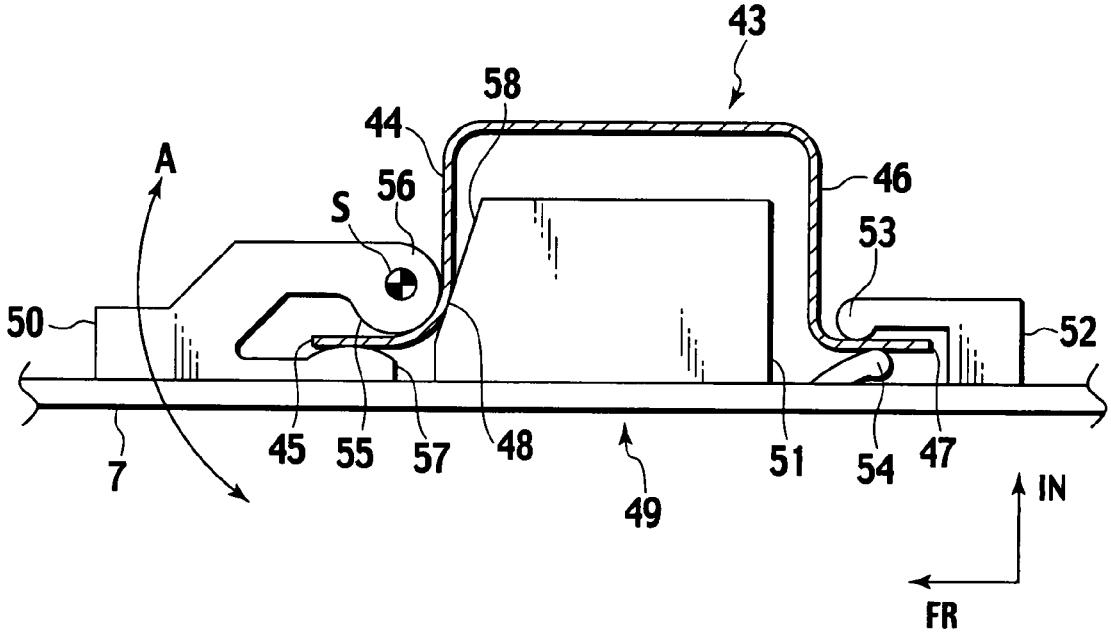
FIG. 9 is a sectional view of relevant parts of a window regulator according to a third embodiment of the present invention.

FIG. 9 is a sectional view of relevant parts of a window regulator according to a third embodiment of the present invention. The window regulator of the third embodiment has like constituent elements as those of the first or second embodiment. Therefore, these like constituent elements are designated with like reference symbols and redundant explanations will be omitted.

In the present embodiment, a curved portion 48 is formed on a corner portion of a boundary between a front wall 44 of the guide rail 43 and a front flange 45.

A carrier plate 49 has three protrusions 50, 51 and 52. The front protrusion 50 is provided with an inscribed projection 56, and the inscribed projection 56 is formed with a curved surface 55 which is inscribed with the curved portion 48. In the present embodiment, the protrusions 50, 51 and 52 and the sandwiching piece 54 correspond to the elements to be guided.

The rear flange 47 formed by bending the rear wall 46 of the guide rail 43 is sandwiched between the projection 53 formed on a protrusion 52 and the sandwiching piece 54 opposed to the projection 53 in the widthwise direction of the vehicle.

The protrusion 50 is provided with a sandwiching piece 57 on the side of the metal plate portion 7 of the inscribed projection 56. The front flange 45 is sandwiched between the sandwiching piece 57 and the inscribed projection 56.

The central protrusion 51 is formed with an abutting surface 58 which is inclined with respect to the longitudinal direction and the widthwise direction of the vehicle. The curved portion 48 is sandwiched between the abutting surface 58 and the curved surface 55. That is, the protrusion 51 corresponds to the circumscribed projection in the present embodiment.

That is, the third embodiment is different from the first and second embodiments in that the protrusion 51 as the circumscribed projection is provided in the guide rail 43 and the inscribed projection 56 is provided outside of the guide rail 43. With this structure, the elements to be guided are turned around the curving center S of the curved portion 48 in accordance with the twist of the guide rail 43, and it can be held with respect to the guide rail 43 more stably. Therefore, it is possible to prevent the carrier plate 49 from rocking and rattling in the widthwise direction and the longitudinal direction of the vehicle.

Fourth Embodiment

Figure 10:
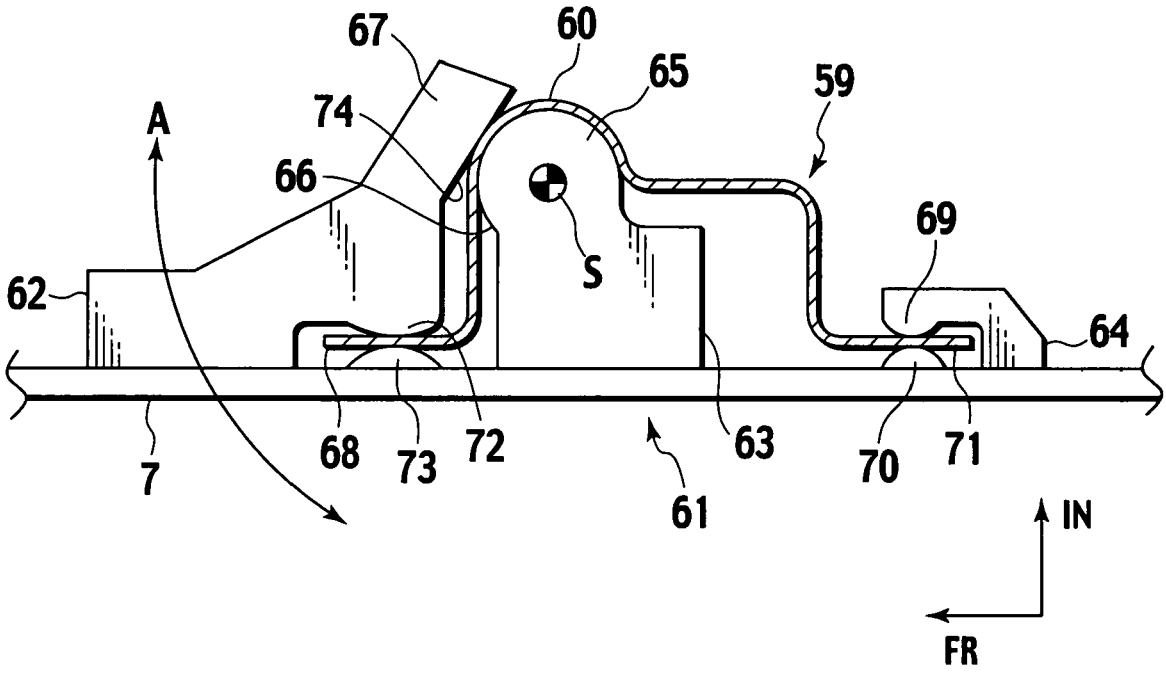
FIG. 10 is a sectional view of relevant parts of a window regulator according to a fourth embodiment of the present invention.

FIG. 10 is a sectional view of relevant parts of a window regulator according to a fourth embodiment of the present invention. The window regulator according to the fourth embodiment has like constituent elements as those of the first to third embodiments. Therefore, these like constituent elements are designated with like reference symbols and redundant explanations will be omitted.

In the present embodiment, the guide rail 59 is provided with a semi-arc curved portion 60 which projects in the widthwise direction of the vehicle. The curved portion 60 also has a substantially constant cross section in the longitudinal direction of the guide rail 59.

The carrier plate 61 is formed with three protrusions 62, 63 and 64. The central protrusion 63 is formed with an inscribed projection 65 having a curved, surface 66 which is inscribed with the curved portion 60. In the present embodiment, these protrusions 62, 63 and 64 and sandwiching pieces 70 and 73 correspond to the elements to be guided.

The inscribed projection 65 is sandwiched in the longitudinal direction of the vehicle by the curved portion 60.

Further, a rear flange 71 is sandwiched between a projection 69 formed on the protrusion 64 and the sandwiching piece 70 opposed to the projection 69 in the widthwise direction of the vehicle.

Meanwhile, the front protrusion 62 is formed with a circumscribed projection 67 having an abutting surface 74 which is circumscribed with the curved portion 60. The protrusion 62 is formed with a projection 72. The projection 72 slides on the flange 68. The flange 68 is sandwiched between the projection 72 and the sandwiching piece 73 opposed to the projection 72 in the widthwise direction of the vehicle.

According to the present embodiment, the curved portion 60 is curved such as to protrude in the widthwise direction of the vehicle, and the inscribed projection 65 is sandwiched by the curved portion 60 in the longitudinal direction of the vehicle. Therefore, even when the guide rail 59 is twisted, the elements to be guided are turned along the curved portion 60 and a prying force is less prone to be applied, the carrier plate 61 can vertically move more smoothly, and friction of the elements to be guided can be suppressed.

Particularly, the present embodiment has a structure for sandwiching the curved portion 60 between the inscribed projection 65 and the circumscribed projection 67, and there is an advantage that it is possible to prevent the carrier plate from rattling more reliably together with the structure for sandwiching the inscribed projection 65 by the curved portion 60 in the longitudinal direction of the vehicle.

Furthermore, the present invention has the relatively simple structure in which the inscribed projection 65 is sandwiched by the curved portion 60 formed on the guide rail 59 and thus, there is an advantage that the vehicular window regulator can be manufactured and assembled more easily.

While preferred embodiments of the present invention have been explained above, the present invention is not limited thereto, and various modifications can be made. For example, the curved surface of the inscribed projection can be formed into a spherical shape, and the abutting surface of the circumscribed projection can be formed into a spherical or a flat shape. Particularly, if the curved surface and the abutting surface are formed into spherical shapes, the contact area is reduced and the sliding friction can be reduced correspondingly.

What is claimed is:

1. A vehicular window regulator comprising:

a guide rail which is fixed to a door and extended in a vertical direction;

a carrier plate; and an element to be guided mounted on the carrier plate and guided by the guide rail so as to allow vertical movement along the guide rail, wherein the guide rail is provided with a curved portion having a substantially constant arc cross section in a longitudinal direction, the element to be guided is provided with an inscribed projection having a curved surface which is inscribed with the curved portion and a circumscribed projection which is circumscribed with the curved portion, and the curved portion is sandwiched between the inscribed projection and the circumscribed projection, and also a gap is formed between the guide rail and the element to be guided, thereby allowing the carrier plate to horizontally rotate about a curving center of the curved portion.

2. The vehicular window regulator according to claim 1, wherein one of the inscribed projection and the circumscribed projection is divided into upper and lower two pieces and they are separated from each other, and the other one of the inscribed projection and the circumscribed projection is disposed between the divided two pieces.

3. The vehicular window regulator according to claim 1, wherein an abutting surface of the circumscribed projection is a spherical surface or a columnar surface.

4. The vehicular window regulator according to claim 1, wherein the guide rail has a substantially hat-shaped cross section protruding in a widthwise direction of a vehicle, the curved portion is disposed at a corner portion of the substantially hat-shaped cross section, and an abutting surface of the circumscribed projection extends along a substantially horizontal direction intersecting with the widthwise direction and a longitudinal direction of the vehicle.

5. The vehicular window regulator according to claim 1, wherein the guide rail has a substantially hat-shaped cross section protruding in a widthwise direction of a vehicle, two flanges are formed in front of and behind the guide rail one each, one of the two flanges is curved into an arc shape around a curving center of the inscribed projection, the element to be guided is formed with an arc receiving groove in which the arc flange is accommodated and the flange slides, and the receiving groove and the one flange slide with each other.

6. A vehicular window regulator comprising:

a guide rail which is fixed to a door and extended in a vertical direction;

a carrier plate; and an element to be guided by the guide rail so as to allow vertical movement along the guide rail, wherein the guide rail is provided with a curved portion having a substantially constant arc cross section in a longitudinal direction, the element to be guided is provided with an inscribed projection having a curved surface which is inscribed with the curved portion, the curved portion is curved such as to protrude in a widthwise direction of a vehicle, and the inscribed projection is sandwiched by the curved portion in a longitudinal direction of the vehicle, and also a gap is formed between the guide rail and the element to be guided, thereby allowing the carrier plate to horizontally rotate about a curving center of the curved portion.

7. A vehicular window regulator comprising:

a guide rail which is fixed to a door and extended in a vertical direction;

a carrier plate; and an element to be guided by the guide rail so as to allow vertical movement along the guide rail, wherein the guide rail is provided with a curved portion having a substantially constant arc cross section in a longitudinal direction, the element to be guided is provided with an inscribed projection having a curved surface which is inscribed with the curved portion and a circumscribed projection which is circumscribed with the curved portion, the curved portion is sandwiched between the inscribed projection and the circumscribed projection, an abutting surface of the inscribed projection is a half-columnar surface, and an abutting surface of the circumscribed projection extends along a substantially horizontal direction intersecting with the widthwise direction and a longitudinal direction of the vehicle.

8. The vehicular window regulator according to claim 7, wherein one of the inscribed projection and the circumscribed projection is divided into upper and lower two pieces and they are separated from each other, and the other one of the inscribed projection and the circumscribed projection is disposed between the divided two pieces.

9. The vehicular window regulator according to claim 7, wherein an abutting surface of the circumscribed projection is a spherical surface or a columnar surface.

10. A vehicular window regulator comprising:

a guide rail which is fixed to a door of a vehicle and extended in a vertical direction; and a carrier plate which vertically moves along the guide rail, while being guided by the guide rail, wherein the guide rail has a substantially hat-shaped cross section protruding in a widthwise direction of the vehicle, the guide rail is provided with a curved portion having a substantially constant arc cross section in a longitudinal direction, the carrier plate has a plate portion extending along in the vertical direction and in a longitudinal direction of the vehicle, and three projections protruding from the plate portion on center, front and rear sides thereof in a widthwise direction of the vehicle, the projection on the center side is provided with one of an inscribed projection having a curved surface which is inscribed with the curved portion and a circumscribed projection which is circumscribed with the curved portion, and the projection on either the front or rear side is provided with the other of the inscribed projection and the circumscribed projection, and the curved portion is sandwiched between the inscribed projection and the circumscribed projection, and also a gap is formed between the guide rail and each of the three projections, thereby allowing the carrier plate to horizontally rotate about a curving center of the curved portion.

* * * * *